US005618095A

United States Patent [19]

Kashima et al.

[11] Patent Number: 5,618,095

[45] Date of Patent: Apr. 8, 1997

[54] BACKLIGHTING DEVICE

[75] Inventors: Keiji Kashima, Saitama; Mitsuru Fukamachi; Naoki Yoshida, both of Kanagawa, all of Japan

[73] Assignee: Tosoh Corporation, Yamaguchi, Japan

[21] Appl. No.: 416,001

[22] Filed: Apr. 4, 1995

[51] Int. Cl.[6] ..... F21V 7/09

[52] U.S. Cl. ..... 362/31; 362/297; 362/346; 362/347; 362/26; 362/300

[58] Field of Search ..... 362/31, 26, 27, 362/300, 302, 297, 346, 347, 217, 350, 260; 359/49, 50

[56] References Cited

U.S. PATENT DOCUMENTS

| | | | |
|---|---|---|---|
| 4,230,095 | 10/1980 | Winston | 126/439 |
| 4,517,631 | 5/1985 | Mullins | 362/217 |
| 4,947,305 | 8/1990 | Gunter, Jr. | 362/347 |
| 5,055,978 | 10/1991 | Bogoff | 362/31 |
| 5,262,928 | 11/1993 | Kashima et al. | 362/31 |
| 5,394,317 | 2/1995 | Grenga et al. | 362/346 |

FOREIGN PATENT DOCUMENTS

| | | | |
|---|---|---|---|
| 4257823 | 9/1992 | Japan | G02F 1/1335 |
| 6186433 | 7/1994 | Japan | 362/31 |

OTHER PUBLICATIONS

Bassett et al, "The Collection of Diffuse Light Onto an Extended Absorber", Optical and Quantum Electronics, 10 (1978) 61–82.

*Primary Examiner*—Ira S. Lazarus
*Assistant Examiner*—Thomas M. Sember
*Attorney, Agent, or Firm*—Sughrue, Mion, Zinn, Macpeak & Seas

[57] ABSTRACT

At least part of a reflector surface covering a rod-shaped light source is a continuous body having such a shape that in a plane perpendicular to the central axis of the rod-shaped light source, a ray emitted from a light emitting point on the surface of the rod-shaped light source in the tangential direction going away from a light conducting plate is reflected back to the vicinity of the light emitting point. According to another aspect, at least part of a reflector surface covering a rod-shaped light source located between the rod-shaped light source and the light conducting plate is part of a parabola whose focus is substantially located on the side face of the light conducting plate in a plane perpendicular to the central axis of the rod-shaped light source.

12 Claims, 7 Drawing Sheets

BACKLIGHTING DEVICE

BACKGROUND OF THE INVENTION

The present invention relates to a light conducting plate used in an edge-light type backlighting device for illuminating a transmission-type or semi-transmission type panel from its back side.

In recent years, thin and legible liquid crystal display devices having a backlighting mechanism are used as display devices for lap-top or book-type word processors, computers, etc. These backlighting devices are of an edge-light type in which, as shown in FIG. 1, a rod-shaped light source (4 in the figure) such as a fluorescent tube is disposed adjacent to one end of a transparent light conducting plate (1 in the figure). In many of the edge-light-type backlighting devices, as shown in FIG. 2, one major surface (back surface) of the light conducting plate is partially covered with a light diffuse-reflecting substance shaped in dots and stripes or formed with a number of protrusions or recesses, and that surface is covered with a light diffuse-reflecting sheet (3 in the figure) almost completely- Further, the light exit surface of the light conducting plate is covered with a light diffusing sheet (2 in the figure).

Recently, in particular, the backlighting devices, which are driven by a battery, are desired to have a further improved consumed-power-to-luminance conversion efficiency. To this end, there have been proposed various methods for causing light rays emitted from the light source to efficiently enter the end face of the light conducting plate by making a reflector that encloses the linear light source have a parabolic or elliptical sectional shape, or a special sectional shape (as disclosed in Japanese Unexamined Patent Publication No. Hei. 4-257823) taken perpendicularly to its longitudinal direction.

However, although each of the above methods can improve the consumed-power-to-luminance conversion efficiency, the degree of improvement is still not enough and further improvement is desired.

SUMMARY OF THE INVENTION

An object of the present invention is to provide a backlighting device which not only provides a high consumed-power-to-luminance conversion efficiency but also a high luminance.

After conducting various investigations on the above points, the present inventors have found that an edge-light-type backlighting device having a high consumed-power-to-luminance conversion efficiency can be obtained by making the reflector that encloses the rod-shaped light source have a certain shape.

It is supposed that in the case where the shape of the reflector is designed by using a ray that is emitted from a particular point (in many cases, the center of the rod-shaped light source) as a standard ray as in many of the conventional cases, many of the rays emitted from the rod-shaped light source return to the rod-shaped light source and are absorbed thereby (the rod-shaped light source is made of light-absorbing materials such as a phosphor, electrodes, mercury, and glass), so that a considerable part of the rays are lost by being converted to heat.

In many cases, the rod-shaped light source (linear light source) used in the edge-light-type backlighting device is a fluorescent tube such as a cold-cathode tube, a hot-cathode tube, and a cold/hot-cathode tube. In such a fluorescent tube, since a fluorescent substance is coated on the inner wall of a rod-shaped glass tube and ultraviolet rays generated within the glass tube are converted to visible rays by the fluorescent substance, visible rays are emitted from points of the fluorescent substance coated on the inner wall of the glass tube. Therefore, as described above, even if the shape of the reflector is so designed as to cause rays emitted from a particular point to efficiently enter the end face of the light conductor, rays that are emitted from a plurality of points (actual light emitting points; for instance, the above fluorescent substance) do not enter the end face of the light conducting plate with a sufficiently high efficiency.

The invention is characterized in that the shape of the reflector that covers the rod-shaped light source of the edge-light-type backlighting device is designed by using rays that are emitted from a plurality of the above-mentioned actual light emitting points (a curve connecting those light emitting points) as standard rays. The inventors have found that this design can greatly improve the above-mentioned consumed-power-to-luminance conversion efficiency.

According to the invention, there is provided a backlighting device comprising a light conducting plate made of a transparent material and having a light diffusing and/or scattering function, and a rod-shaped light source disposed in proximity to at least one side face of the light conducting plate, wherein at least part of a reflector surface covering the light source is a continuous body having a shape which reflects a ray that is emitted from a light emitting point of the rod-shaped light source in a direction tangential to the light source, perpendicular to the central axis thereof, and going away from the light conducting plate back to a vicinity of the light emitting point in a cross-section taken perpendicularly to a longitudinal central axis of the rod-shaped light source.

After conducting further investigations, the inventors have found that rays emitted from the light source can efficiently enter the end face of the light conducting plate by making the reflector surface that covers the light source assume a particular shape in a region between the rod-shaped light source and the light conducting plate.

That is, according to another aspect of the invention, there is provided a backlighting device comprising a light conducting plate made of a transparent material and having a light diffusing and/or scattering function, and a rod-shaped light source disposed in proximity to at least one side face of the light conducting plate, wherein in a cross-section taken perpendicularly to a central axis of the rod-shaped light source, a reflector surface covering the light source is part of a parabola in a region between the rod-shaped light source and the light conducting plate, and a focus of the parabola is located substantially on the side face of the light conducting plate.

DESCRIPTION OF THE PREFERRED EMBODIMENTS

Figure 1:
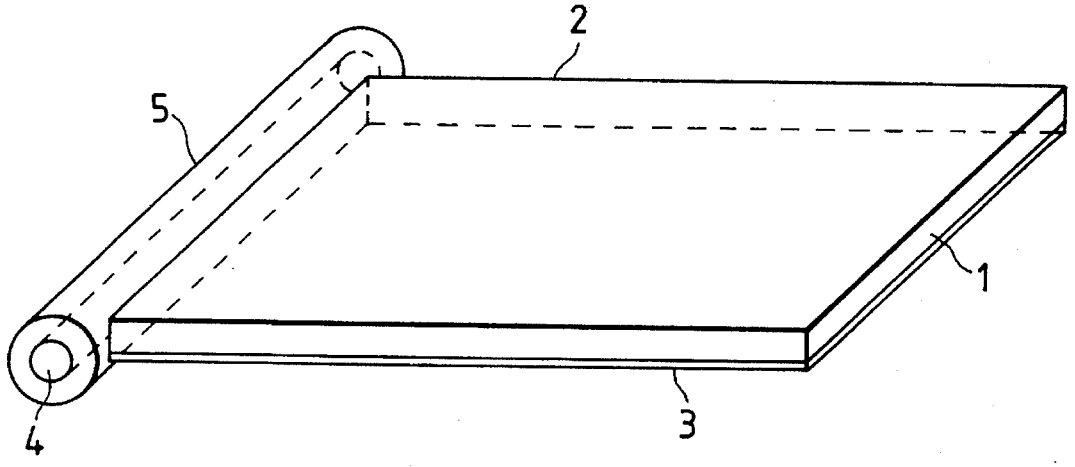
FIG. 1 PRIOR ART
FIG. 1 is a perspective view of a conventional backlighting device.

The present invention will be further described with reference to the drawings.

Each of FIGS. 3–21 is a sectional view showing a rod-shaped light source and a reflector surface covering it according to (part of) an embodiment of the invention. In those figures, reference numeral 1 denotes a light conducting plate, which may be made of a material that has a light diffusing and/or scattering function and efficiently transmit light, for instance, quartz, glass, or a transparent natural or synthetic resin such as an acrylic resin. The light diffusing and/or scattering function may be imparted to the inside or a surface of the light conducting plate. To impart, to the inside of the light conducting plate, the light diffusing and/or scattering function of causing rays entering through its side face to exit from its major surface, the light conducting plate used may be made of two or more materials having different refractive indices. Although there is no specific limitation on those materials, one example is such that two or more kinds of polymers (each being of a large number) having different refractive indices are located at very small intervals.

The light conducting plate is not necessarily required to have front and back major surfaces being parallel with each other, i.e., have a constant thickness. There is also used a plate whose thickness gradually decreases as the distance from the side adjacent to a light source (described later) increases, i.e., a light conducting plate having a wedge-shaped cross-section.

There is no specific limitation on the method of imparting, to a major surface of the light conducting plate, the light-diffusing and/or scattering function of causing rays entering through its side face end portion to exit from its major surface. In one example, a light diffusing and/or scattering material (6 in the figures) is printed in, for instance, dots or stripes on the surface of the light conducting plate by, for instance, screen printing. The light diffusing and/or scattering material is a medium, such as paint or printing ink, in which silica, barium sulfate, magnesium oxide, aluminum oxide, calcium carbonate, titanium white, glass beads, resin beads, or minute air bubbles are dispersed in a transparent material such as an acrylic-ester resin or a vinyl resin. In another example, a large number of protrusions in the forms of minute cones, pyramids, straight strips, or trapezoidal strips are formed on the surface of the light conducting plate so as to be optically joined to the light conducting plate. In still another example, a large number of recesses in the forms of minute cones, pyramids, straight strips, or trapezoidal strips are formed on the surface of the light conducting plate so as to be optically joined to the light conducting plate. In a further example, the surface of the light conducting plate is roughened.

Reference numeral 4 denotes a rod-shaped light source. In a preferred structure, the rod-shaped light source is so disposed that its central axis is approximately parallel with the end face of the light conducting plate to thereby allow rays to enter the end portion of the light conducting plate. The portion of the reflector surface which is not opposed to the end portion of the light conducting plate is covered with a reflector surface (7 in the figures). Examples of the rod-shaped light source 4 are a fluorescent tube, a tungsten incandescent tube, an optical rod, and a rod-like arrangement of LEDs. Among those light sources, the fluorescent tube is preferable, in which case it is preferred that the uniform light emitting portion except the electrode portions is approximately as long as the adjacent end portion of the light conducting plate from the viewpoints of the power saving and the uniformity of the luminance distribution in an effective light emitting area.

In this invention, the rod-shaped light source is defined as a light source in which a certain curve (for instance, a circle or an ellipse) is formed in a cross-section taken perpendicularly to the longitudinal direction of the rod-shaped light source when a plurality of light emitting points are smoothly connected, as in the case of a fluorescent material coated on the inside wall of a glass tube of a fluorescent tube. There is no specific limitation on the size of the cross-section taken perpendicularly to the longitudinal direction of the rod-shaped light source except that it should not be a point. However, a smaller rod-shaped light source is preferred to reduce the size of the backlighting device. It is preferred that its maximum outside dimension be smaller than 8mm, and more preferred that its maximum outside dimension be smaller than 4 mm. In particular, where the rod-shaped light source is a fluorescent tube such as a cold-cathode tube, it is preferred that the maximum outside dimension be larger than 1mm from the viewpoints of the mechanical strength, life, etc.

The invention is characterized in that the reflector surface covering the rod-shaped light source is so disposed as to assume a particular shape. That is, part of the reflector surface (7 in the figures) is a continuous body (7*a* in the figures) which is so formed as to reflect a ray that is emitted from a light emitting point in the tangential direction going away from the light conducting plate substantially back to the same light emitting point.

In the invention, it is preferred that the reflector surface is a specular reflecting surface. It is sufficient that the specular reflecting surface substantially specularly reflect an incident ray (regular reflection; a ray incident at an angle θ with respect to the normal to the reflecting surface is reflected at an angle −θ). There is no specific limitation on the material of the reflector surface. Examples of the material of the reflector surface are silver, aluminum, platinum, nickel, chromium, gold, and copper. Among those materials, silver and aluminum are preferred. Although the ideal specular reflection that is completely free of diffuse-reflection is most preferable, actually there remains a certain degree of diffuse-reflection for reasons in manufacture. Even with the latter reflector surface, the effects of the invention can be obtained sufficiently.

In the invention, the reflector surface can be a molded product of a polymer compound formed with a specular reflecting surface. For example, a polymer material such as an ABS, ACS, or PC resin is preliminarily formed into the shape of the reflector surface by injection molding, and then a specular reflecting surface is formed by evaporating Ag, Al, or the like thereon. Alternatively, a plate is prepared by forming a laminate specular reflecting surface of silver, aluminum, etc. on a metal plate of aluminum or brass, and then the plate is formed into the shape of the reflector surface by metal-mold forming.

Figure 11:
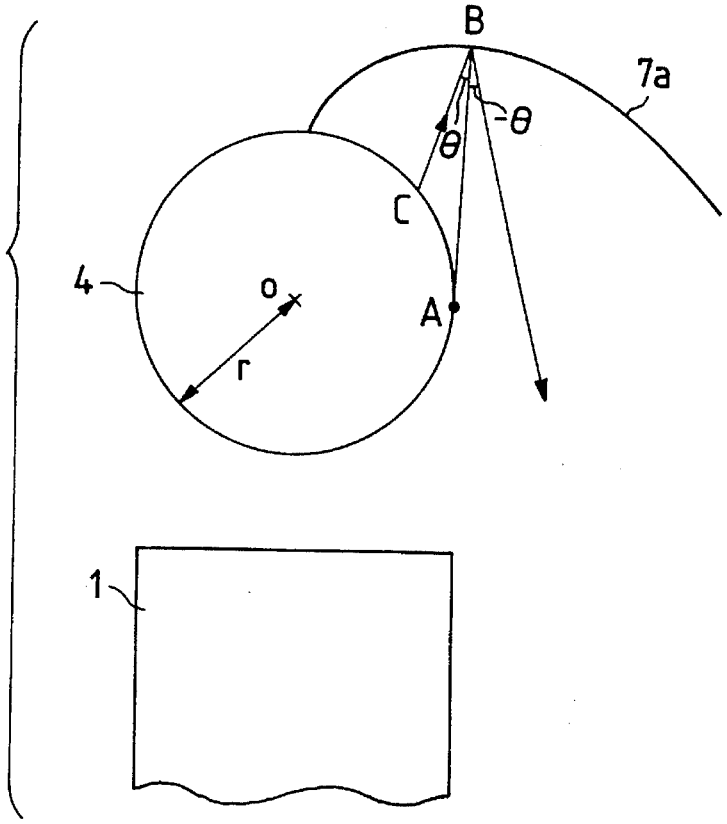
FIG. 11 illustrates a function of a continuous body of a specular reflecting surface of the backlighting device of the invention.

Referring to FIG. 11, a detailed description will be made of the condition for constituting the reflector surface of the invention. A ray emitted from, for instance, a light emitting point (A in the figure) of the rod-shaped light source in the tangential direction at this light emitting point going away (see line segment AB in the figure) from the light conducting plate (1 in the figure) should be substantially perpendicular to a very small plane (B in the figure) where the ray strikes the continuous body (7*a* in the figure) of the reflector surface. That is, a ray emitted from an arbitrary light emitting point on a curve obtained by smoothly connecting a plurality of light emitting points of the rod-shaped light source in the tangential direction at the arbitrary light emitting point should substantially coincide with the normal of a plane where the ray strikes the continuous body of the reflector surface. In other words, the continuous body of the reflector body should substantially coincide with the involute of a curve obtained by smoothly connecting a plurality of light emitting points mentioned above. In FIG. 11, O denotes the center of the rod-shaped light source; r, a radius of the rod-shaped light source; and θ, an angle.

In a cross-section taken perpendicularly to the longitudinal direction of the rod-shaped light source, at least part of the continuous body (7*a* in the figure) of the reflector surface substantially coincides with the above-mentioned involute. However, for instance, for reasons in manufacture, the continuous body will have a certain degree of asperity and the curve itself is given a certain allowance (referring to FIG. 11, when a ray emitted from the light emitting point A in the tangential direction is reflected by the reflecting surface 7*a*, a return ray will have a variation defined by a circle whose center is the light emitting point A and radius is 0.2 r). It goes without saying that the scope of the invention includes such variations.

If a ray incident on the reflector surface coincides with the normal to the reflector surface, it returns to a light emitting point after being reflected by the reflector surface. In the invention, the continuous body of the reflector surface means a continuous body of very small reflecting planes satisfying such a condition. To enhance the effects of the invention, it is particularly preferable that to form the continuous body, the very small reflecting planes be connected as smoothly as possible within the range permitted by the manufacture.

Where the reflector surface (7 in the figure) has the above continuous body (7*a* in the figure), rays emitted from the rod-shaped light source reach the end face of the light conducting plate very efficiently, so that the consumed-power-to-luminance conversion efficiency is greatly improved. This is explained as follows. Attention is now paid to an arbitrary very small plane, for instance, plane B in the figure, of the continuous body of the reflector surface. Since the normal to the very small plane substantially coincides with the tangential line of the light emitting point (A in the figure) of the rod-shaped light source as described above, a ray emitted from any other arbitrary light emitting point (for instance, point C in the figure) of the rod-shaped light source is not reflected back to the rod-shaped light source when it strikes the very small plane (B in the figure) under attention. That is, a ray emitted from an arbitrary light emitting point of the rod-shaped light source (except a ray traveling along the tangential direction at the light emitting point) and then reflected by the continuous body of the reflector surface never returns to the rod-shaped light source.

Where there exists glass or some other material having a refractive index different than air between a light emitting point and the continuous body of the reflector surface, a ray emitted from the light emitting point is refracted at the boundary with the material having the different refractive index. However, in the invention, since the refracting direction can easily be calculated according to Snell's law, even where there exists a material having a refractive index different than air between the light emitting points and the continuous body of the reflector surface, the continuous body of the reflector surface may be so formed as to reflect a ray emitted from a light emitting point in its tangential direction going away from the light conducting plate substantially back to the light emitting point.

If rays emitted from the light emitting points of the rod-shaped light source do not return to the rod-shaped light source as described above, there are no rays that are absorbed by the rod-shaped light source. Thus, it becomes possible to provide a backlighting device that has a high consumed-power-to-luminance conversion efficiency and, therefore, has a high luminance. The amount of rays traveling along the tangential line of a light emitting point is negligible compared with the amount of all the rays emitted from the same light emitting point in all the directions.

It is sufficient that the continuous body (7*a* in the figure) of the reflector surface substantially cover the surface of the rod-shaped light source other than the part that is opposed to the light conducting plate. However, it is preferred that the continuous body is formed at least in such a region that one of the two rays emitted from an arbitrary light emitting point in its opposite tangential directions does not directly enter the light conducting plate and the other ray strikes the reflector surface. By forming the continuous body of the reflector surface in this manner, rays that are emitted from the portion of the rod-shaped light source not facing the light conducting plate, a large part of which rays would otherwise become a loss, can efficiently be introduced into the light conducting plate.

As for the shortest distance between the continuous body of the reflector surface and the rod-shaped light source, they may be partially contacted with each other. However, where the rod-shaped light source is a fluorescent tube or the like that is supplied with a high-frequency voltage rather than a DC voltage, it is preferred that the shortest distance be longer than 0.1 mm, more preferably longer than 0.5 mm, to minimize a high-frequency current loss between the continuous body of the reflector surface and the rod-shaped light source.

There is no specific limitation on the joining condition of the continuous body of the reflector surface (7 in the figure) which satisfies the condition of the invention and the other portion of the reflector surface. However, to effectively utilize the rays, it is preferred that the above two portions be connected optically smoothly. There is no specific limitation on the shape of the portion of the reflector surface other than the continuous body (*7a* in the figure). The portion other than the continuous body may have such shapes as a straight line, part of an ellipse, part of a parabola, and part of a circle. To effectively utilize the rays, it is preferred that the shape be part of an ellipse or part of a parabola.

From the viewpoints of effective utilization of rays and the manufacture, it is preferred that in a cross-section taken perpendicularly to the longitudinal central axis of the rod-shaped light source, the reflector surface is approximately parallel with the major surface of the light conducting plate and is substantially symmetrical with respect to a straight line passing through the center of the rod-shaped light source. The same thing applies to reflector surfaces of other preferred embodiments described below. Where one of the major surfaces of the backlighting device should be flat for mechanical reasons, a shape shown in FIG. 10 may be employed.

After further investigations, the inventors have found the following. That is, to cause rays emitted from the rod-shaped light source to effectively reach the side face end portion of the light conducting plate by reflecting those rays, it is preferred that in a cross-section taken perpendicularly to the longitudinal direction of the rod-shaped light source, at least part of the portion (*7b* in the figures) of the reflector surface located between the light conducting plate and the rod-shaped light source be part of a parabola whose focus is substantially located on the end face of the light conducting plate or in its vicinity.

Figure 17:
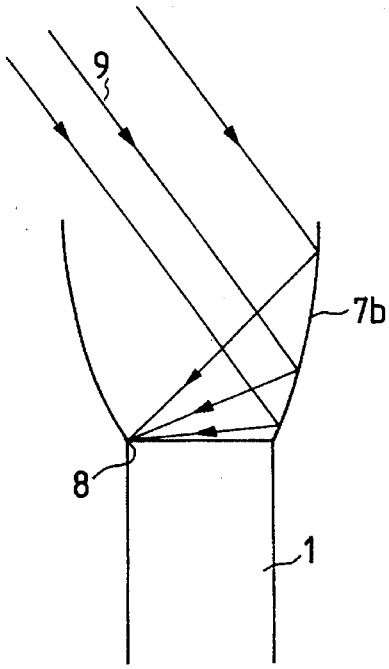
FIG. 17 illustrates a function of a continuous body of a specular reflecting surface of the backlighting device of the invention.
Figure 18:
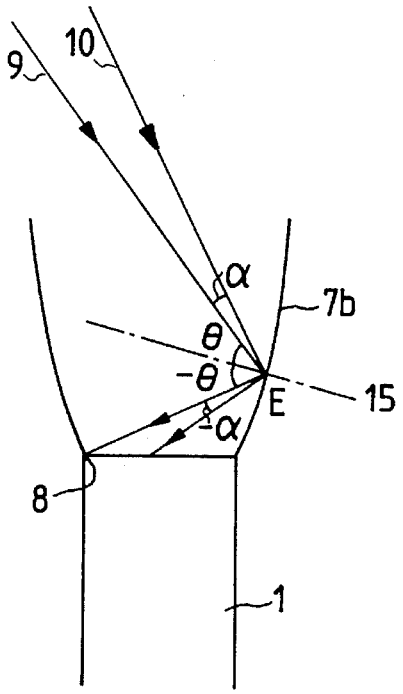
FIG. 18 illustrates a function of a continuous body of a specular reflecting surface of the backlighting device of the invention.

A more detailed description will be made of the above condition of the invention with reference to FIGS. 17 and 18. The focus (8 in the figures) of the continuous body (*7b* in the figures; part of a parabola) of the reflector surface should be substantially located on the end face of the light conducting plate. For example, where parallel rays (9 in the figures) are incident on the continuous body (*7b* in the figures) of the reflector surface along a certain direction, those rays should be collected onto the end face of the light conducting plate. For reasons in manufacture, the continuous body of the reflector surface will have a certain degree of asperity and the curve itself is given a certain allowance (the above-described variation defined by the circle having a radius 0.2 r). It goes without saying that the scope of the invention includes such variations.

If the reflector surface (7 in the figures) has the above continuous body (*7b* in the figures), rays emitted from the rod-shaped light source reach the end face of the light conducting plate very efficiently, so that the consumed-power-to-luminance conversion efficiently is greatly improved. This is explained as follows. With attention paid to an arbitrary very small plane, for instance, plane E in the figure, of the continuous body of the reflector surface, parallel rays (9 in the figure) incident on the very small plane along a certain direction are reflected and collected onto the focus (8 in the figure) as described above. Therefore, a ray (10 in the figure) incident on the very small plane with an angular deviation $\alpha$ from the certain direction 9 to the side of its tangential direction is reflected with an angular deviation $-\alpha$and strikes the end face of the light conducting plate at a position on the right side of the focus 8 in the figure. That is, all the rays incident on the very small plane with angular deviations within a range from the certain direction 9 to the tangential direction of the very small plane reach the end face of the light conducting plate.

Where all the rays incident on the very small plane with angular deviations within a range from the certain direction 9 to the tangential direction of the very small plane reach the end face of the light conducting plate, there exists no ray that is returned to and absorbed by the rod-shaped light source. Thus, it becomes possible to provide a backlighting device that has a high consumed-power-to-luminance conversion efficiency and a high luminance.

As for the positional relationship between the continuous body of the reflector surface *7b* and the rod-shaped light source, the rod-shaped light source may be placed between the continuous bodies of the reflector surface which are opposed to each other. To enhance the effects of the invention, it is preferred that the rod-shaped light source is placed at a position more distant from the light conducting plate than an intersecting point in the opposed portions of the reflector surface which is formed by connecting the end portions of the opposed continuous bodies of the reflector surface so that they intersect each other.

It is preferred that the end faces of the reflector surface 7 be optically joined to the portions of the major front surface and/or back surface of the light conducting plate close to the side face end portions. With this structure, rays emitted from the rod-shaped light source and rays reflected by the reflector surface can efficiently be introduced into the light conducting plate. (In this specification, "optical joining" means a joining state which can minimize the optical loss.)

The main part of the invention has been described above. Further, a description will be made of other preferable configurations.

Figure 16:
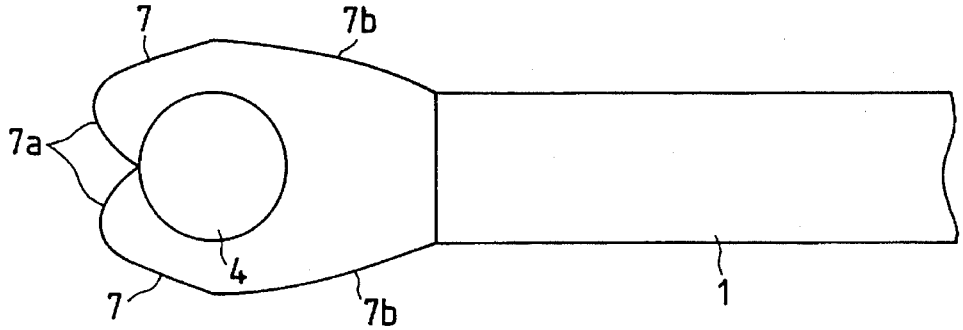
FIG. 16 is a sectional view showing a portion of a backlighting device including the rod-shaped light source according to an embodiment of the invention.

In a configuration shown in FIG. 16, the continuous body (*7b* in the figure) of the reflector surface which is part of a parabola and the continuous body (*7a* in the figure) of the reflector surface according to the first aspect of the invention are used together. This configuration is preferable because it can enhance the effects of the invention. This is so because where the continuous body (*7a* in the figure) of the reflector surface is used with the rod-shaped light source, exit angles of rays are restricted to a certain range; that is, rays traveling toward the light conducting plate in directions closer to the direction parallel with the major surface of the light conducting plate can be collected. Therefore, many rays are made incident on the other continuous body (*7b* in the figure) of the reflector surface with angles smaller than the angle of the certain direction (9 in the figure) as described above, so that rays emitted from the rod-shaped light source can be utilized very efficiently.

It is preferred that the end faces of the continuous bodies (*7b* in the figure) of the reflector surface be optically joined to the portions of the major front surface and/or back surface of the light conducting plate close to the side face end portions. With this structure, rays can efficiently reach the end face of the light conducting plate.

Figure 19:
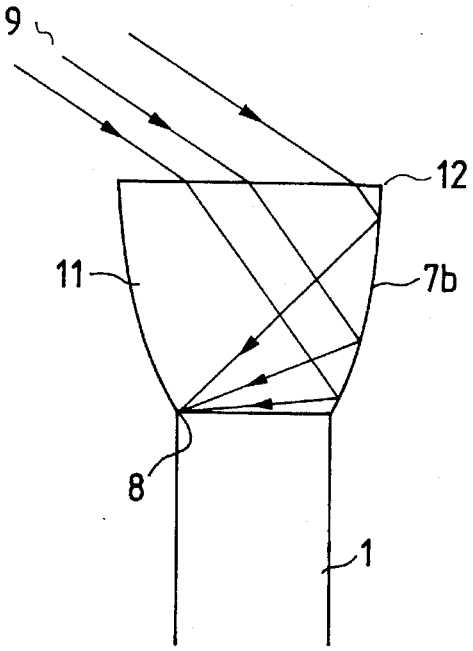
FIG. 19 illustrates a function of a backlighting device of the invention in which a transparent material is disposed between the continuous bodies of the opposed specular reflecting surfaces.

In a configuration shown in FIG. 19, a transparent material (11 in the figure) whose refractive index is larger than air is provided between the opposed continuous bodies (*7b* in the figure) in the region between the rod-shaped light source and the light conducting plate. With this configuration, the angle of the certain direction (9 in the figure) with respect to the major surface of the light conducting plate can be made larger optically. Therefore, this configuration is preferable because it allows more rays to be utilized effectively.

Figure 20:
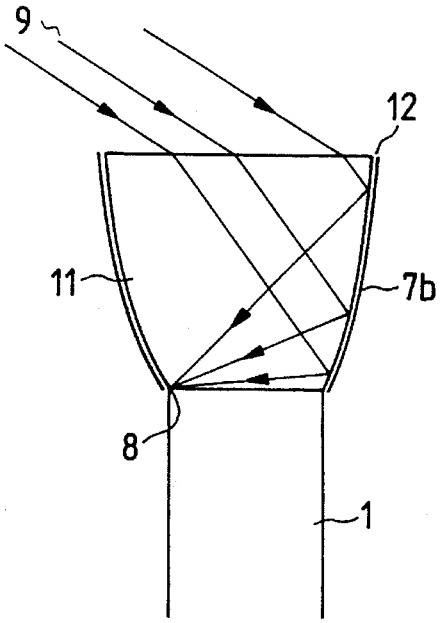
FIG. 20 illustrates a function of a backlighting device of the invention in which an air layer is provided between the transparent material and the continuous bodies of the specular reflecting surfaces.

In a configuration shown in FIG. 20, an air layer is interposed between the transparent material (11 in the figure) and the continuous body (*7b* in the figure) of the reflector surface. This configuration enables more effective utilization of rays, because rays entering the transparent material 11 are subjected to total reflection at the surface (that is in contact with the air) of the transparent material.

Figure 21:
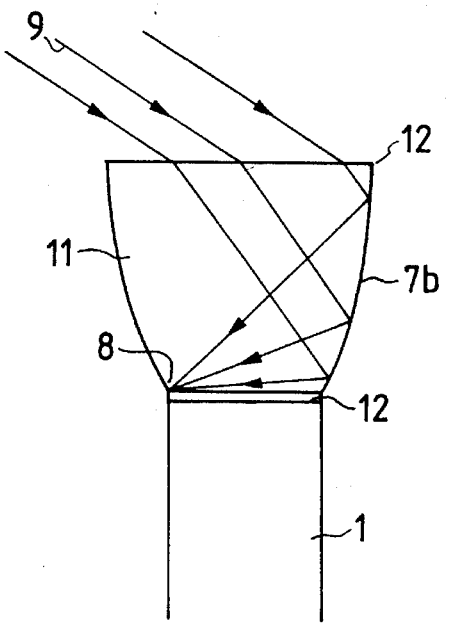
FIG. 21 illustrates a function of a backlighting device of the invention in which an air layer is provided between the transparent material and the light conducting plate.

Further, in a configuration shown in FIG. 21, an air layer 12 is interposed between the transparent material 11 and the end face of the light conducting plate 1. This configuration is preferable, because rays coming to the end face of the light conducting plate can be converted to rays that are repeatedly subjected to total reflection in the light conducting plate, which makes it easier to provide uniform plane-like light emission.

A light diffusing sheet (2 in the figures) serves to pass light that is output from the light conducting plate surface while scattering it. One or a plurality of light diffusing sheets are used in accordance with the need. A light reflecting sheet (3 in the figures) is placed so as to cover almost entirely the surface of the light conducting plate to which surface a light scattering-transmission and/or light diffuse-reflection treatment has been applied, and reflects light.

Examples and Comparative Example

Figure 2:
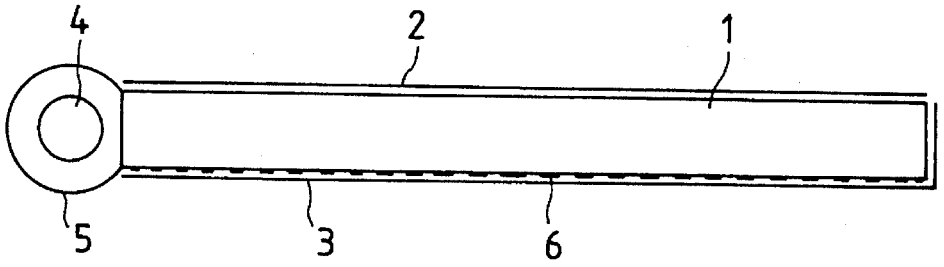
FIG. 2 PRIOR ART
FIG. 2 is a sectional view of the conventional backlighting device.
Figure 3:
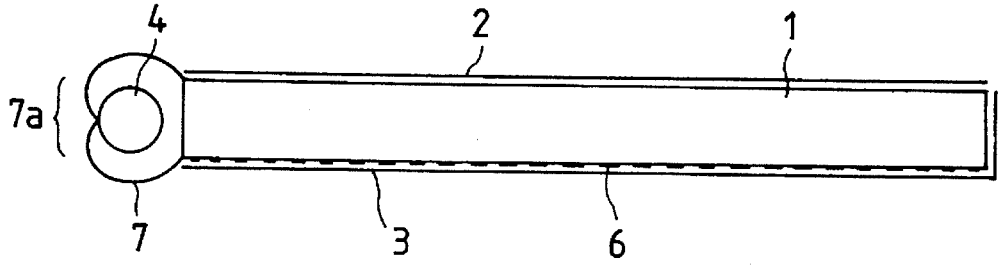
FIG. 3 is a sectional view showing a backlighting device according to an embodiment of the invention.
Figure 4:
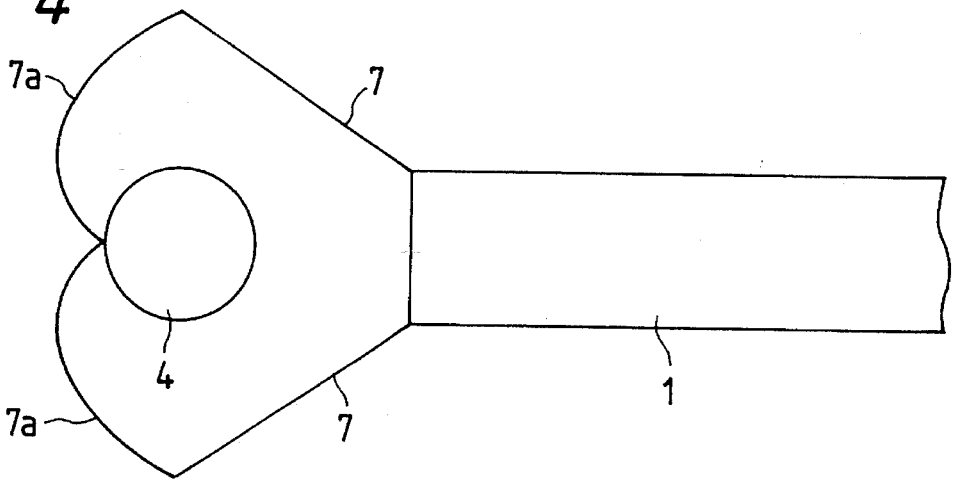
FIG. 4 is a sectional view showing a portion of a backlighting device including a rod-shaped light source according to an embodiment of the invention.
Figure 5:
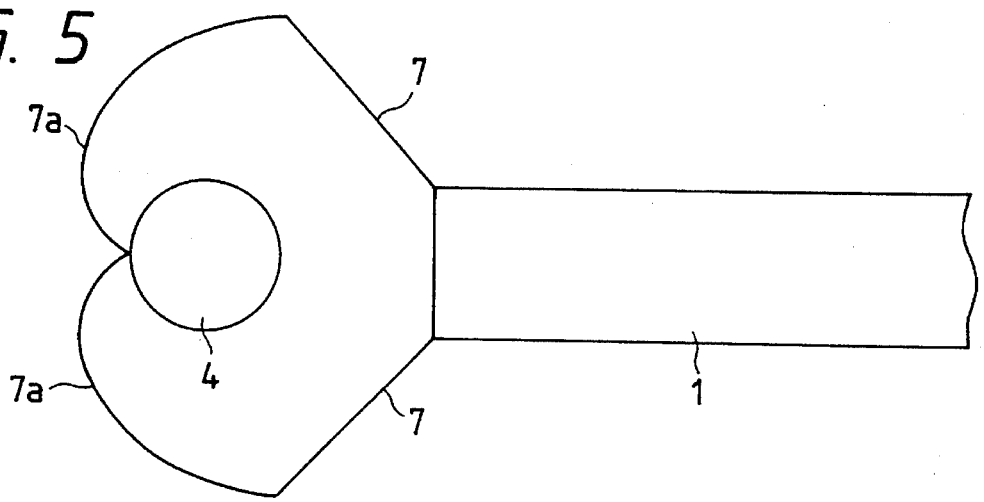
FIG. 5 is a sectional view showing a portion of a backlighting device including the rod-shaped light source according to an embodiment of the invention.
Figure 6:
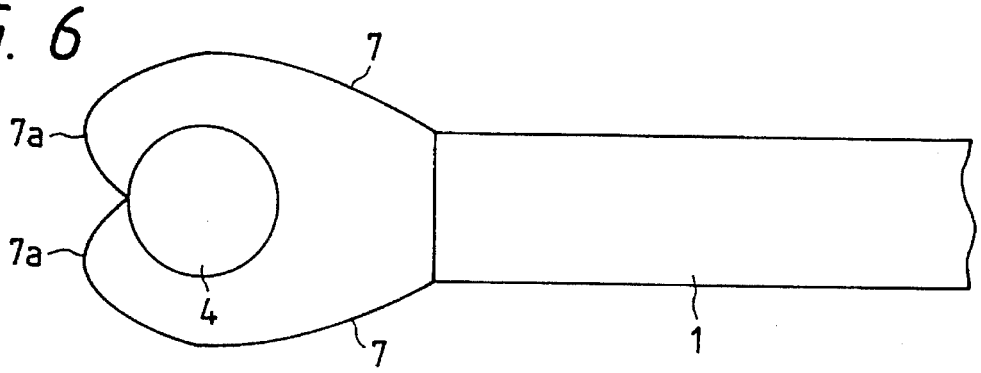
FIG. 6 is a sectional view showing a portion of a backlighting device including the rod-shaped light source according to an embodiment of the invention.
Figure 7:
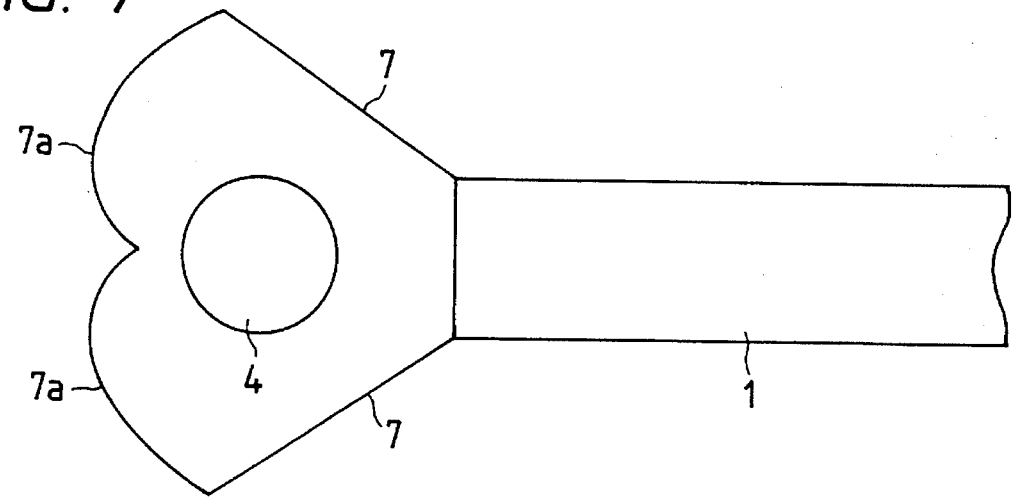
FIG. 7 is a sectional view showing a portion of a backlighting device including the rod-shaped light source according to an embodiment of the invention.
Figure 8:
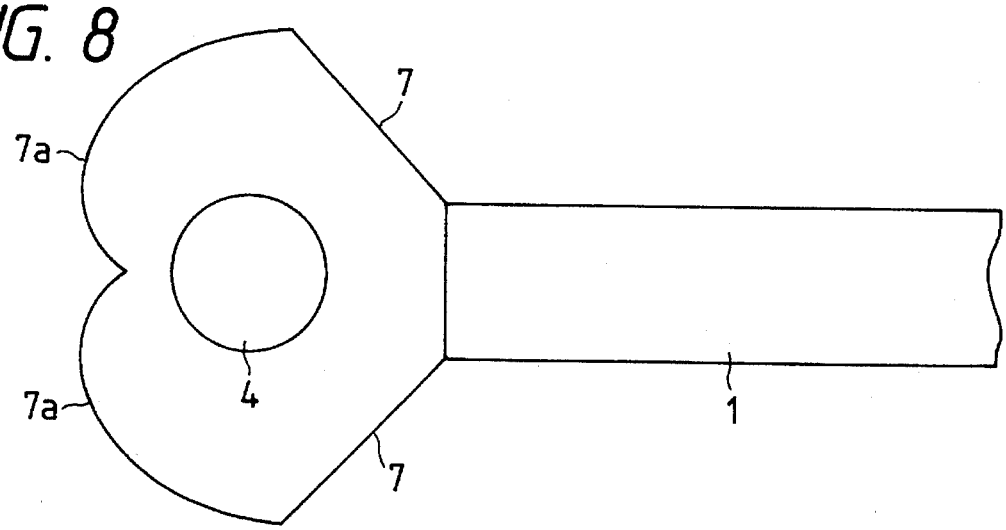
FIG. 8 is a sectional view showing a portion of a backlighting device including the rod-shaped light source according to an embodiment of the invention.
Figure 9:
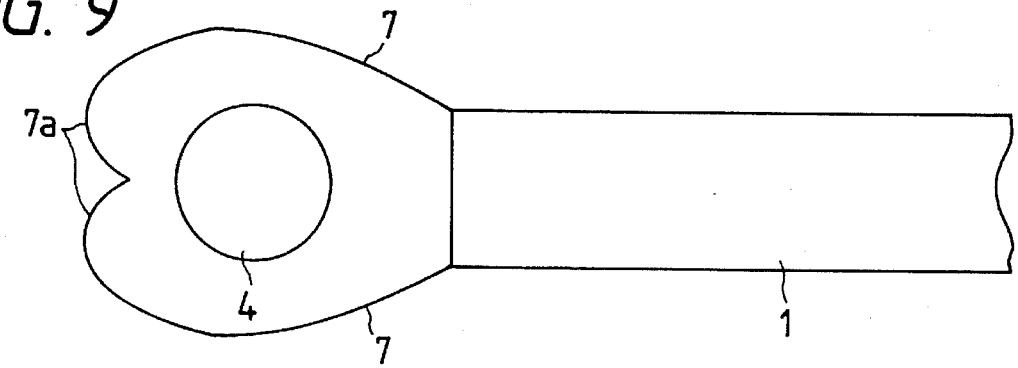
FIG. 9 is a sectional view showing a portion of a backlighting device including the rod-shaped light source according to an embodiment of the invention.
Figure 10:
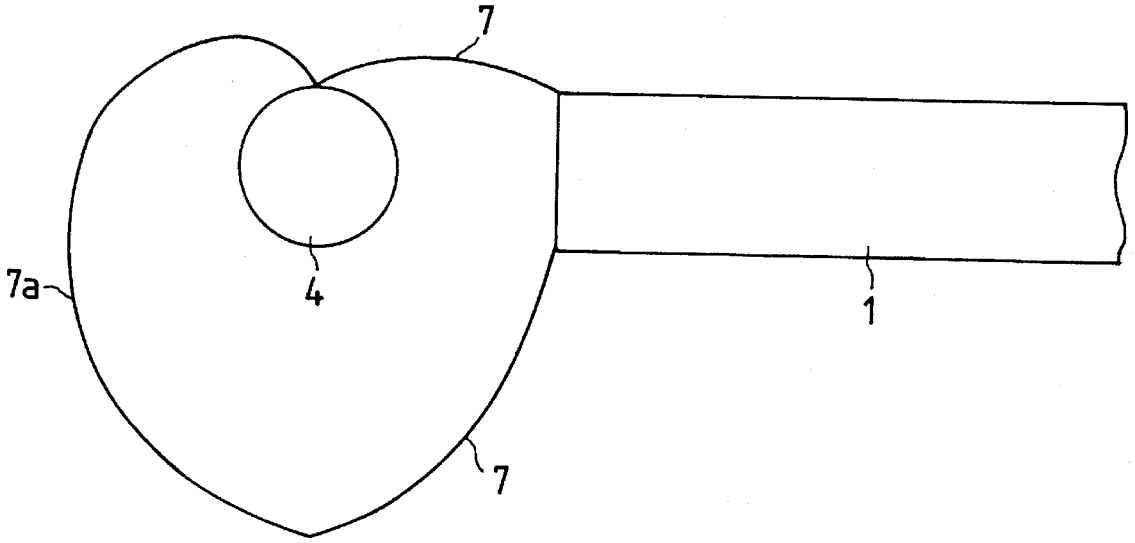
FIG. 10 is a sectional view showing a portion of a backlighting device including the rod-shaped light source according to an embodiment of the invention.

A cold-cathode fluorescent tube (produced by Harrison Electric Co., Ltd.) was such that the inner surface is coated with a fluorescent material, the outside and inside diameters are 3 mm and 2 mm, and a cross-section taken perpendicularly to the longitudinal direction of a glass tube is circular. This fluorescent tube was disposed adjacent to the shorter-side end portion of a rectangular light conducting plate (produced by Asahi Chemical Industry Co., Ltd.) made of PMMA and having a thickness of 3 mm and a size of 225 mm×127 mm (see FIG. 2) so that the central axis of the fluorescent tube is approximately parallel with the end face of the light conducting plate. The fluorescent tube was covered with an ABS reflector in which silver is evaporated onto its inner surface. A cross-section of the silver-evaporated surface (specular reflection surface) of the reflector taken perpendicularly to the longitudinal direction of the glass tube was made circular. Ink containing titania was applied in dots to the back surface of the light conducting plate by screen printing so that the coating ratio (per unit area) became larger (i.e., coating became denser) as the position goes away from the light source, to thereby realize a state that rays entering the light conducting plate through the end face are output from the light exit surface with a uniform distribution. A light diffuse-reflection sheet (Merinex 329 produced by ICI) made of white PET was placed on the back surface of the light conducting plate. A light diffusing sheet (8B36 produced by Sansei Bussan Co., Ltd.) made of PC was placed on the light exit surface (front surface) of the light conducting plate.

The surface luminance was measured with a luminance meter (BM-8 produced by Topcon Corp.) under a condition that constant power in the form of an AC voltage of 30 kHz was applied from an inverter (produced by TDK Corp.) to the coldcathode tube. (Comparative Example)

Then, the cross-sectional shape of the reflector was calculated according to the following equation so that in a cross-section taken perpendicularly to the longitudinal direction of the glass tube (see FIG. 3), the silver-evaporated surface of the reflector has a portion (*7a* in the figure) substantially coincides with the above-described involute of the inner surface of the cold-cathode tube.

Figure 12:
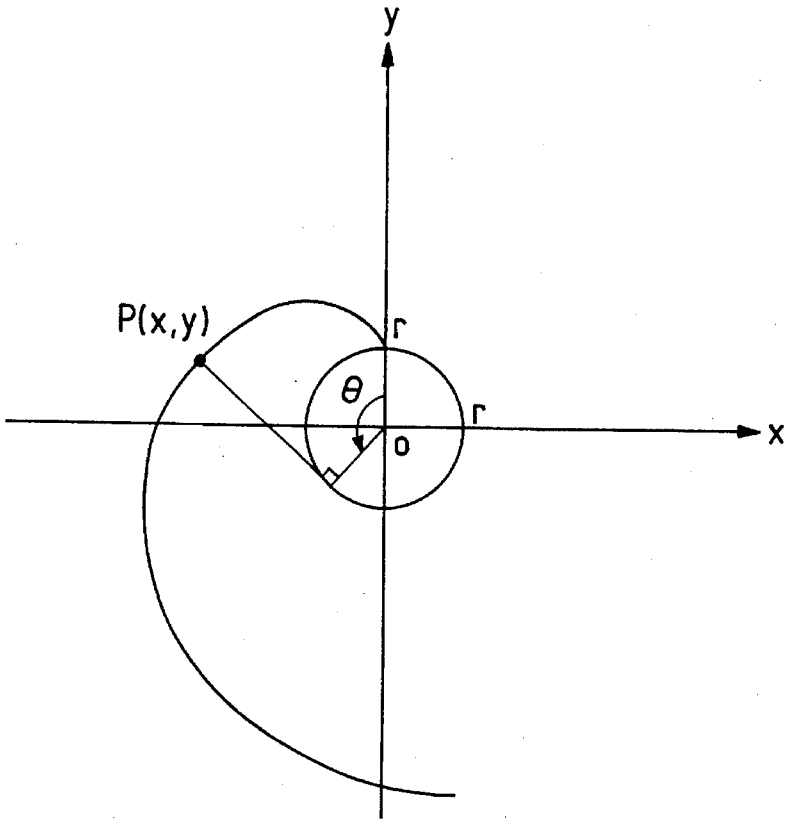
FIG. 12 illustrates equations for calculating the shape of the continuous body of the specular reflecting surface of the invention in the case where the rod-shaped light source has a circular cross-section.

Referring to FIG. 12, a backlighting device was assembled in the same manner as in the Comparative Example except that the cross-section of the reflector has a portion that substantially coincides with P(x, y), where $$x=-r\cdot\sin\theta+r\theta\cdot\cos\theta$$

$$y=r\cdot\cos\theta+r\theta\cdot\sin\theta.$$

A measurement showed a luminance increase of about 10% from the case of the Comparative Example. (Example 1)

An investigation was made to determine which portion (*7a* in the figures) of the reflecting surface of the reflector should substantially coincide with the involute of the inner surface of the above cold-cathode fluorescent tube, to maximize the efficiency of light utilization. It has been found that good results are obtained with an involute portion that occupies at least a portion corresponding to the tangential line going away from the light conducting plate with such an arbitrary light emitting point of the rod-shaped light source used as a reference that a ray emitted therefrom in the tangential direction approaching the light conducting plate does not directly enter the light conducting plate. (Example 2)

A comparison was made between the case where the end face of the reflector surface is optically joined to the portion of the major surface of the light conducting plate close to the side face end portion and the case where it is not. A higher luminance was obtained in the case where the joining was made. (Example 3)

Where silver was evaporated, to form a specular reflecting surface, onto the portion of the reflecting surface of the reflector other than the portion (*7a* in the figures) that substantially coincides with the above-described involute, the manufacture of the reflector was facilitated and the luminance was increased. (Example 4)

Where the portion of the reflecting surface of the reflector other than the portion (*7a* in the figures) that substantially coincides with the above-described involute was made of a light diffusing sheet (Merinex 329 produced by ICI), the luminance did not decrease much even if the former portion includes some asperity. (Example 5)

Figure 13:
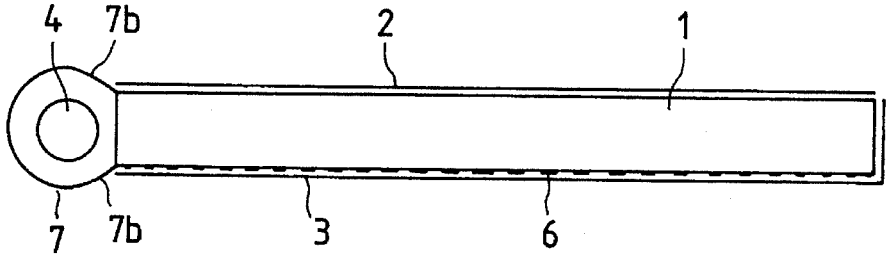
FIG. 13 is a sectional view showing a backlighting device according to an embodiment of the invention.

A backlighting device was assembled in the same manner as in Comparative Example except that as shown in FIG. 13, at least part of a cross-section taken perpendicularly to the longitudinal direction of the reflector surface is part of a parabola whose focus is substantially located on the end face of the light conducting plate. A measurement showed a luminance increase of about 7% from the case of the Comparative Example. (Example 6)

A comparison was made between the case where the focus of the parabola is substantially located on the portion of the end face of the light conducting plate close to its major surface and the case where it is not. The former case showed a higher luminance. (Example 7)

Figure 14:
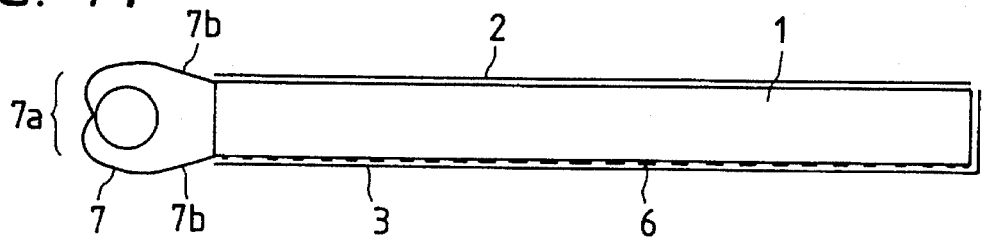
FIG. 14 is a sectional view showing a backlighting device according to an embodiment of the invention.
Figure 15:
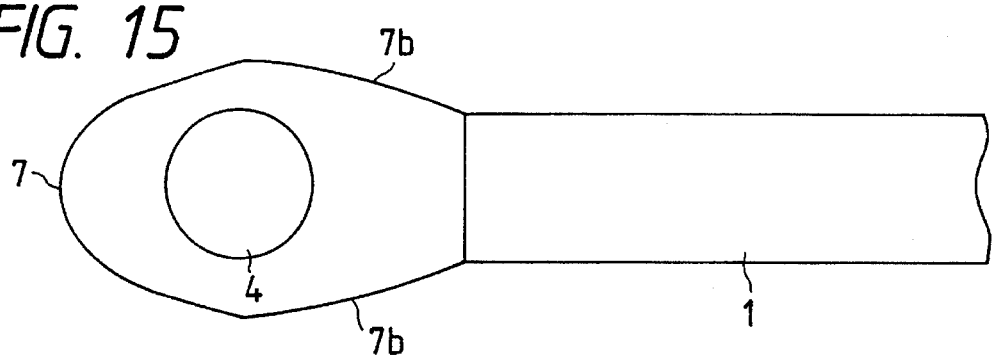
FIG. 15 is a sectional view showing a portion of a backlighting device including the rod-shaped light source according to an embodiment of the invention.

A backlighting device was assembled in the same manner as in Example 1 except that as shown in FIG. 14, at least part of a cross-section taken perpendicularly to the longitudinal direction of the reflector surface is part of a parabola and that the focus of the parabola is substantially located on the end face of the light conducting plate. A measurement showed a luminance increase of about 20% from the case of Example 1. (Example 8)

A backlighting device was assembled in the same manner as in Example 6 except that as shown in FIG. 19, a transparent material (PMMA) having a refractive index larger than air was provided between the continuous bodies of the opposed specular reflecting surfaces whose cross-section is substantially a parabola. A measurement showed a luminance increase from the case of Example 6. (Example 9)

A backlighting device was assembled in the same manner as in Example 9 except that an air layer was provided between the transparent material and the specular reflecting surfaces. A measurement showed a luminance increase from the case of Example 9. (Example 10)

A backlighting device was assembled in the same manner as in Example 9 except that an air layer was provided between the transparent material and the end face of the light conducting plate. A measurement showed improved luminance uniformity compared with the case of Example 9. (Example 11)

The same tests were conducted on backlighting devices in which the parallel light conducting plate was replaced by a wedge-shaped light conducting plate whose thickness gradually decreases from 3 mm at the light source side to 1.2 mm at the portion farthest from the light source. Results were similar to those in the above tests.

The invention can provide the backlighting device which has a high consumed-power-to-luminance conversion efficiency and a high luminance.

What is claimed is:

1. A backlighting device comprising:

a light conducting plate made of a transparent material and having at least one of a light diffusing and a light scattering function;

a rod-shaped light source disposed in proximity to at least one side face of the light conducting plate; and a reflector surface covering the rod-shaped light source, at least part of the reflector surface being a continuous body having a shape which reflects a ray that is emitted from a light emitting point on a surface of the rod-shaped light source in a tangential direction going away from the light conducting plate back to a vicinity of the light emitting point in a plane perpendicular to a central axis of the rod-shaped light source, the continuous body of the reflector surface being formed in such a region that after being reflected back to the vicinity of the light emitting point on the surface of the rod-shaped light source, the ray does not directly reach a light entrance surface of the light conducting plate.

2. A backlighting device comprising:

a light conducting plate made of a transparent material and having at least one of a light diffusing and a light scattering function;

a rod-shaped light source disposed in proximity to at least one side face of the light conducting plate; and a reflector surface covering the rod-shaped light source, at least part of the reflector surface corresponding to a region between the rod-shaped light source and the light conducting plate being part of a parabola having a focus that is substantially located on the side face of the light conducting plate in a plane perpendicular to a central axis of the rod-shaped light source.

3. The backlighting device of claim 2, wherein the focus is substantially located on the side face of the light conducting plate in the vicinity of a light exit surface or a surface opposed thereto of the light conducting plate.

4. The backlighting device of claim 2, wherein at least part of the reflector surface is a continuous body having a shape which reflects a ray that is emitted from a light emitting point on a surface of the rod-shaped light source in a tangential direction going away from the light conducting plate back to a vicinity of the light emitting point in a plane perpendicular to the central axis of the rod-shaped light source.

5. The backlighting device of claim 2, wherein a transparent material having a refractive index larger than air is disposed in a space formed by the rod-shaped light source, the light conducting plate, and the reflector surface.

6. The backlighting device of claim 5, wherein an air layer is interposed between the reflector surface and the transparent material.

7. The backlighting device of claim 5, wherein an air layer is interposed between the light conducting plate and the transparent material.

8. The backlighting device of any one of claims 1 or 2–7, wherein an end portion of the reflector surface on the side of the light conducting plate is optically joined to a light exit surface or a surface opposed thereto of the light conducting plate in the vicinity of the side face.

9. The backlighting device of any one of claims 1 or 2–7, wherein the reflector surface is a specular reflecting surface.

10. The backlighting device of any one of claims 1 or 2–7, wherein the reflector surface is substantially symmetrical with respect to a straight line approximately parallel with a light exit surface of the light conducting plate and passing through the center of the rod-shaped light source in a plane perpendicular to the central axis of the rod-shaped light source.

11. The backlighting device of any one of claims 1 or 2–7 wherein the continuous body of the reflector surface is a specular reflecting surface formed on a surface of a molded product of a polymer compound.

12. The backlighting device of any one of claims 1 or 2–7 wherein the continuous body of the reflector surface is a specular reflecting surface formed on a surface of a metal plate.

* * * * *